US005749529A

United States Patent [19]

Kazama et al.

[11] Patent Number: 5,749,529

[45] Date of Patent: May 12, 1998

[54] METHOD OF PRODUCING CORONA DISCHARGE AND ELECTROSTATIC PAINTING SYSTEM EMPLOYING CORONA DISCHARGE

[75] Inventors: Shigenori Kazama, Sagamihara; Ryo Sasaki, Ebina, both of Japan

[73] Assignee: Nissan Motor Co., Ltd., Kanagawa, Japan

[21] Appl. No.: 508,512

[22] Filed: Jul. 28, 1995

[30] Foreign Application Priority Data

Jul. 29, 1994 [JP] Japan ..... 6-179005
Jun. 1, 1995 [JP] Japan ..... 7-135427

[51] Int. Cl.[6] ..... B05B 5/00

[52] U.S. Cl. ..... 239/690; 239/703; 239/704; 239/706; 239/707; 118/626

[58] Field of Search ..... 239/3, 690, 699, 239/700, 703, 704, 705, 706, 707; 118/626; 361/227, 228, 220; 313/348, 360.1

[56] References Cited

U.S. PATENT DOCUMENTS

| | | | |
|---|---|---|---|
| 3,130,487 | 4/1964 | Mears | 313/350 X |
| 3,202,857 | 8/1965 | Antoniades | 313/350 |
| 3,659,151 | 4/1972 | Fabre | 239/3 |
| 4,051,405 | 9/1977 | Lee et al. | 313/361.1 |
| 4,266,721 | 5/1981 | Sickles | 239/3 |
| 4,478,370 | 10/1984 | Hastings | 239/707 |
| 4,502,629 | 3/1985 | McGhee et al. | 239/3 |
| 4,824,026 | 4/1989 | Tamura et al. | 239/707 |
| 5,178,330 | 1/1993 | Rodgers | 239/707 |
| 5,358,182 | 10/1994 | Cappeau et al. | 239/703 |
| 5,484,472 | 1/1996 | Weinberg | 96/26 |

*Primary Examiner*—Andres Kashnikow
*Assistant Examiner*—Lisa Ann Douglas
*Attorney, Agent, or Firm*—McDermott, Will & Emery

[57] ABSTRACT

An electrostatic painting system for painting an object or article under corona discharge. The system comprises a spray gun which is formed at its tip end with annular air ejection opening through which air is ejected under pressure to atomize liquid paint ejected from a paint ejection opening formed at the tip end of the spray gun. An annular wire netting-like negative electrode is fixedly disposed at the tip end of the spray gun and located coaxially around the air ejection opening. The electrode functions to form an electrostatic field and a corona discharge field between the electrode and the object to be painted and to provide electric charge to the atomized paint, upon a high negative voltage being applied to the electrode.

21 Claims, 6 Drawing Sheets

METHOD OF PRODUCING CORONA DISCHARGE AND ELECTROSTATIC PAINTING SYSTEM EMPLOYING CORONA DISCHARGE

BACKGROUND OF THE INVENTION

1. Field of the Invention

This invention relates to a method of producing corona discharge, for example, to provide electric charge to particles of paint in order to improve a coating efficiency of the paint in an electrostatic painting, and to an electrostatic painting system in which the charging amount of the paint particles are increased to largely improve the coating efficiency of the paint.

2. Description of the Prior Art

In an electrostatic painting, an object to be painted serves as a positive electrode while a spray gun for a paint serves as a negative electrode and is supplied with a negative high voltage, so that an electrostatic field is formed between the positive and negative electrodes. Accordingly, atomized particles of the paint from the spray gun is negatively charged and attracted to the painted object as the positive electrode so as to be coated on the surface of the object. It will be understood that by virtue of using electrostatic effect, the electrostatic painting is excellent in the coating efficiency of the paint as compared with usual spray painting while providing advantages in which the front and rear side surfaces of the object can be simultaneously painted.

A variety of types of spray guns are known to be used in the electrostatic painting. For example, there are ones of the air-atomization type wherein liquid paint is atomized by compressed air, ones of the airless-atomization type wherein liquid paint is atomized under pressure of itself, and ones of the rotary atomization type wherein the liquid paint is atomized under the action of centrifugal force of a rotating cap-shaped or disc-shaped spraying head. These spray guns are provided at its tip end section with an atomization mechanism for atomizing liquid paint and with the electrode for forming the electrostatic field between it and the object to be painted. The electrode of the spray gun is disposed inside or in front of the atomization mechanism.

The electrode of the spray gun is maintained in a condition to apply a negative high voltage of about −30 to −90 to the object to be painted. In order to provide electric charge to paint particles after atomization of the paint, a high voltage of 2 to 4 kV/cm is applied between the electrode provided at the tip end section of the spray gun and the object to be painted thereby forming a corona discharge field thereby to produce ions. These ions are attached to the atomized paint particles so that the paint particles are charged. Additionally, it is often made for the purpose of charging the paint under a so-called contact electrification, that the paint is brought into contact with the electrode immediately before leaving from the spray gun.

In case of accomplishing the above electrostatic painting, it is usual that the object to be painted is grounded while the negative high voltage is applied to the electrode of the spray gun. This is because stability of corona discharge is high while a limit voltage over which spark discharge occurs is set high, as compared with a case in which positive high voltage is applied to the electrode.

However, drawbacks have been encountered in the above-discussed electrostatic painting, as set forth below. That is, a pin-shaped electrode having a sharply pointed tip end section is usually used as the electrode of the spray gun in order to obtain stable corona discharge current; however, this makes it impossible to obtain a sufficient charge current. More specifically, assume that a thick pin-shaped electrode having a large cross-sectional area is used to increase the corona discharge current thereby increasing the charged amount of the paint particles. Corona discharge is difficult to be produced and therefore it is necessary to maintain the voltage at a high level, resulting that spark discharge tends to occur. On the contrary, assuming that a thin pin-shaped electrode is used, a sufficient current value of corona discharge cannot be obtained so that the charged amount of the paint particles are lowered.

Otherwise, even if a plurality of such thin pin-shaped electrodes are used for the electrode of the spray gun, only several electrodes will produce stable corona discharge. In a certain case, only one thin pin-shaped electrode which is located the nearest to the object to be painted, of all the electrodes produces stable corona discharge. Accordingly, with the above-discussed conventional electrode(s) of the spray gun, it is difficult to increase corona discharge current. In view of this, conventional devices or systems employing corona discharge are required to overcome the above problems.

Furthermore, there is a case that the electrode of the spray gun is disposed far from the center axis of the spray gun if water-soluble paint is used in the electrostatic painting. However, in case of using a solvent type paint, the spray gun is often arranged such that the electrode is disposed on the central axis of the paint atomization mechanism of the spray gun so as to cause the electrode to contact with the paint in order to simplify the structure of an electrostatic painting system and cause the contact electrification of the particles of the paint in addition to the electric charging due to corona discharge. In such a case, if the voltage to be applied to the electrode is increased over a certain level, there arises problems in which the charged amount of the paint particle and the coating efficiency tend to saturate at their relatively low levels.

In other words, the paint is atomized after contacting with the high voltage electrode, and therefore a part of the atomized paint has been already charged with electric charge similar to that due to corona discharge. As a result, it is assumed that even if corona discharge is produced thereafter, the electric charge due to corona discharge and the electric charge of the paint are similar to each other and therefore repel each other, so that a considerable increase in charging amount upon using both contact electrification and corona charging cannot be expected.

The negative charges due to negative ions or electrons released by corona discharge are far light and small as compared with particles of paint, and therefore the flight speed of them is high as compared with that of paint particles. As a result, the electric charges reached to the object to be painted is flown into an earth device through the surface of the painted object, during which the electric charge are stored at the surface of the painted object so that repellent force is produced between the painted object and the electrically charged paint particles which are flying to the painted object. Although light and small paint particles exist at the outer peripheral part of atomized paint particle flow or mass, it is assumed that a major part of the negative ions produced by corona discharge are impeded with the electric charges of the relatively large charged paint particles occupying a major part of the paint particles, so that the paint particles at the outer peripheral part of the atomized paint particle flow cannot be charged, contrary to the expectation.

SUMMARY OF THE INVENTION

It is an object of the present invention to provide an improved corona discharge producing method and an electrostatic painting system employing corona discharge, which can overcome drawbacks encountered in conventional similar methods and systems.

Another object of the present invention is to provide an improved corona discharge producing method which can effectively increase corona discharge current (corona current) without raising applied voltage in corona discharge, thereby making possible to increase a charging amount of particles of paint without occurring spark discharge in electrostatic painting.

A further object of the present invention is to provide an improved electrostatic painting system employing corona discharge, which can effectively increase a charging amount of particles of paint and a coating efficiency without occurring spark discharge.

The present inventors have conducted researches and developments on shape of an electrode of a spray gun forming part of a electrostatic painting system employing corona discharge, for the purpose of increasing a corona discharge current (corona current) to a voltage applied to the electrode. As a result, the inventors have found that the corona discharge current can be effectively increased by forming the electrode for the corona discharge, into the shape of wire netting.

This has been clearly experimentally demonstrated in FIG. 1 which is a graph showing the effect of shape of an electrode of a spray gun on the corona discharge current from the electrode in terms of the voltage applied to the electrode. In FIG. 1, a line a indicates a case of using a pin-shaped tungsten having a diameter of 0.5 mm as the electrode; and a line b indicates another case that the electrode is formed of a disc-shaped wire netting which is woven from tungsten wires having a diameter of 0.02 mm and has a mesh size of 50 mesh in which the linear dimension (along the wire) of each opening is 297 mm. It has been confirmed from the experimental data of FIG. 1, that the electrode of the disc-shaped wire netting exhibits a level of corona discharge current which is two times of that of the pin-shaped electrode.

Additionally, the corona discharge current upon using the electrode formed of the disc-shaped wire netting is adjustable by changing factors such as area of the wire netting, mesh size (dimension of each opening formed by the wires), diameter of the wires constituting the wire netting, and like. It has been also confirmed that the electrode formed of the disc-shaped wire netting exhibits the level of the corona discharge current of two to several times of that of the pin-shaped electrode by suitably selecting the above-mentioned factors.

In experiments to obtain the data of FIG. 1, an aluminum foil was used as an opposite (positive) electrode and located spaced apart by 200 mm from the negative electrode (the above-mentioned pin-like electrode or the electrode formed of the disc-shaped wire netting), the aluminum foil being grounded. The corona discharge current was determined by measuring a current value of electric current flowing through the aluminum foil.

The principle of the present invention is based on the above fact and characterized by forming one of opposite electrodes, into the wire netting-like shape before production of corona discharge upon applying high voltage between the opposite electrodes.

An aspect of the present invention resides in a method of producing corona discharge, comprising the following steps: (a) providing first and second opposite electrodes; (b) forming the first electrode of a material selected from group consisting of a wire netting-like material and an electrically conductive plastic;

(c) applying a high voltage between the first and second opposite electrodes to produce corona discharge.

Another aspect of the present invention resides in a method of producing corona discharge, comprising the following steps: (a) providing first and second opposite electrodes; (b) forming the first electrode into a wire netting-like shape; and (c) applying a high voltage between the two opposite electrodes to produce corona discharge.

With the above aspects of the present invention, one of the electrodes is formed into the wire netting-like shape or is formed of the electrically conductive plastic, and therefore the corona discharge current generated during corona discharge can be effectively increased without raising voltage applied to the electrode, thereby increasing electric charge amount to particles such as paint particles. This largely improves performance and safety of a system or apparatus employing corona discharge.

A further aspect of the present invention resides in an electrostatic painting system comprising: a spray gun including means for atomizing a liquid paint to obtain atomized particles of the paint, and an electrode for forming an electrostatic field and a corona discharge field between the electrode and an object to be painted and for providing electric charge to the atomized particles of the paint, the electrode being wire netting-like.

With the above aspects of the present invention, the spray gun of the electrostatic painting system is provided with the wire netting-like electrode for producing corona discharge, and therefore the corona discharge current during the corona discharge can be effectively increased without increasing voltage applied to the electrode, thereby increasing the electric charge amount to paint particles ejected from the spray gun. This largely improves a coating efficiency of the paint to the object to be painted, in the electrostatic painting.

A still further aspect of the present invention reside in an electrostatic painting method comprising the following steps of: (a) providing at least first and second electrodes to which high voltage is applied; (b) causing a liquid paint to contact with the first electrode before atomization of the liquid paint; (c) atomizing the liquid paint to form atomized paint particles; (d) ejecting first air to form first air stream surrounding the atomized paint particles; and (e) causing the first air stream to contact with the second electrode.

A still further aspect of the present invention resides in an electrostatic painting system comprising: a spray gun including means for atomizing a liquid paint to obtain atomized particles of the paint, and a first electrode which is contactable with the liquid paint before atomization of the liquid paint; means for ejecting first air to form first air stream surrounding the atomized paint particles; and a second electrode which is contactable with the first air stream to form an electrostatic field and a corona discharge field between the second electrode and an object to be painted and for providing electric charge to the atomized paint particles.

With this aspect of the present invention, one electrode is arranged to be in contact with the liquid paint in a state before atomization, while the other electrode is arranged to be in contact with the air flow stream surrounding the atomized paint particles.

Accordingly, the paint particles are electrically charged under contact electrification in addition to corona discharge without increasing voltage applied to the electrodes, and therefore the electric charge amount of the paint particles flying toward the painted object can be effectively increased thereby raising the coating efficiency of the paint to the painted object. This greatly improves the performance of an electrostatic painting system employing corona discharge.

BRIEF DESCRIPTION OF THE DRAWINGS

In the drawings, like reference numerals designate like parts and elements throughout all figures, in which.

DETAILED DESCRIPTION OF THE INVENTION

Figure 1:
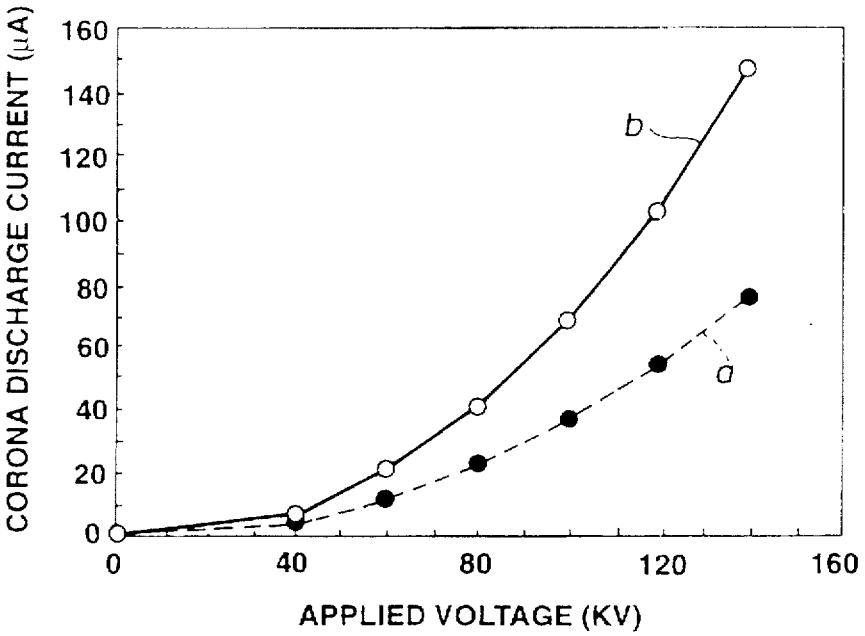
FIG. 1 is a graph showing effect of the shape of an electrode on corona discharge current in corona discharge.
Figure 2:
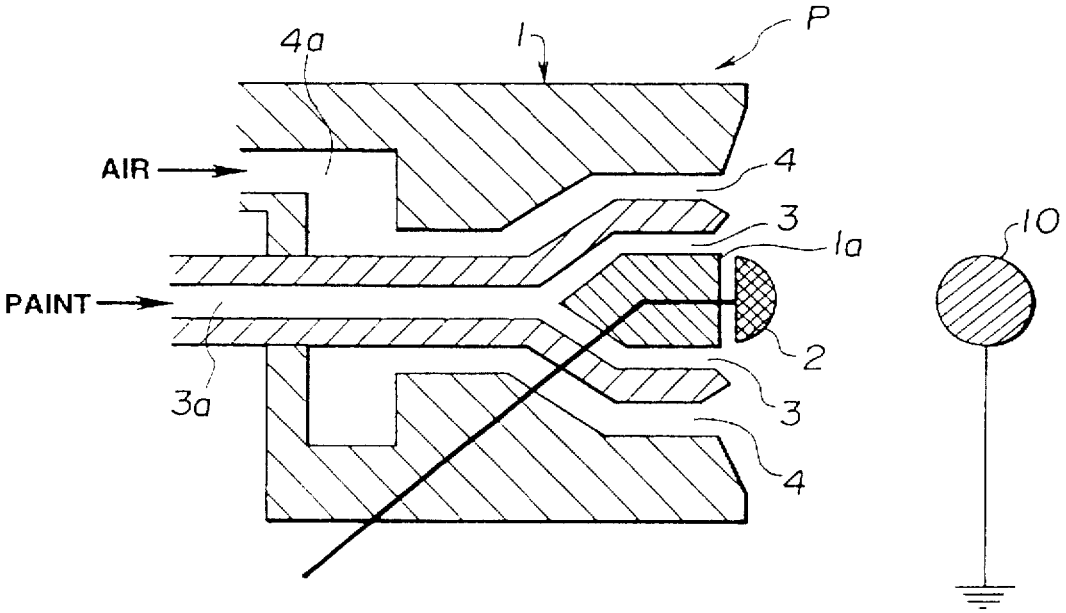
FIG. 2 is a fragmentary schematic sectional view of an essential part of a first embodiment of an electrostatic painting system according to the present invention.

Referring now to FIG. 2, an essential part of a first embodiment of an electrostatic painting system according to the present invention is generally illustrated by the reference character P. The electrostatic painting system P comprises a spray gun 1 which includes a wire netting-like negative electrode 2 which is formed generally dome-shaped or hemispherical and has an outer diameter of 20 mm. The wire netting-like negative electrode 2 is formed by weaving tungsten wires (materials) having a diameter of 0.02 mm and has a mesh size of 50 mesh.

The electrode 2 is fixedly disposed at the front tip end side and located such that the axis (not shown) of the spray gun 1 passes through the electrode 2. More specifically, the electrode 2 is fixedly disposed immediately in front of a tip end central portion 1*a* of the spray gun 1, so that the electrode 2 is generally axial with the tip end central portion 1*a*.

An annular paint ejection opening 3 is formed coaxially around the tip end central portion 1*a* and opened at the front tip end side of the spray gun 1. The paint ejection opening 3 is communicated with a paint supply passage 3*a* through which paint flows under pressure. Additionally, an annular air ejection opening 4 is coaxially formed around the paint ejection opening 3 and opened at the front tip end side of the spray gun 1. The air ejection opening 4 is communicated with an air supply passage 4*a* through which air flows under pressure. It will be understood that liquid paint ejected from the paint ejection opening 3 is spread into the high pressure flow of air from the air ejection opening to be atomized. Thus, the paint ejection opening 3 and the air ejection opening 4 constitute an atomization mechanism for paint.

The wire netting-like electrode 2 is connected to a negative terminal of a high voltage generating device (not shown) and forms an electrostatic field and a corrona discharge field (in which corona discharge is produced) between it and an object 10 to be painted, the object being grounded and serving as an opposite or positive electrode. The wire netting-like electrode 2 functions to provide electric charge to the atomized particles of the paint.

With such an electrostatic painting system P, when electric power is applied to the electrostatic painting system P, a negative high voltage is applied to the wire netting-like electrode 2 of the spray gun 1 thereby forming a corona discharge current between it and the grounded object to be painted. Paint is ejected from the paint ejection opening 3 to a space around the wire netting-like electrode 2 and atomized under the high pressure flow of air ejected from the air ejection opening 4. The atomized paint particles are then brought into contact with corona discharge current and electrically charged.

The charged paint particles are carried to the vicinity of the painted object by air flow and effectively adhere to the painted object under the action of their inertial force and coulomb force due to electric charges provided thereto. At this time, by virtue of using the wire netting-like electrode 2 as the electrode for producing corona discharge, the corona discharge current is increased as compared with a conventional case in which a pin-shaped electrode is used for the same purpose, on the assumption that the same voltage is applied in the both cases. This increases the electric charge amount to the paint particles thereby increasing the coulomb force during adhering of the paint particle to the painted object thus to largely improve the coating efficiency of the paint to the object to be painted.

Figure 3:
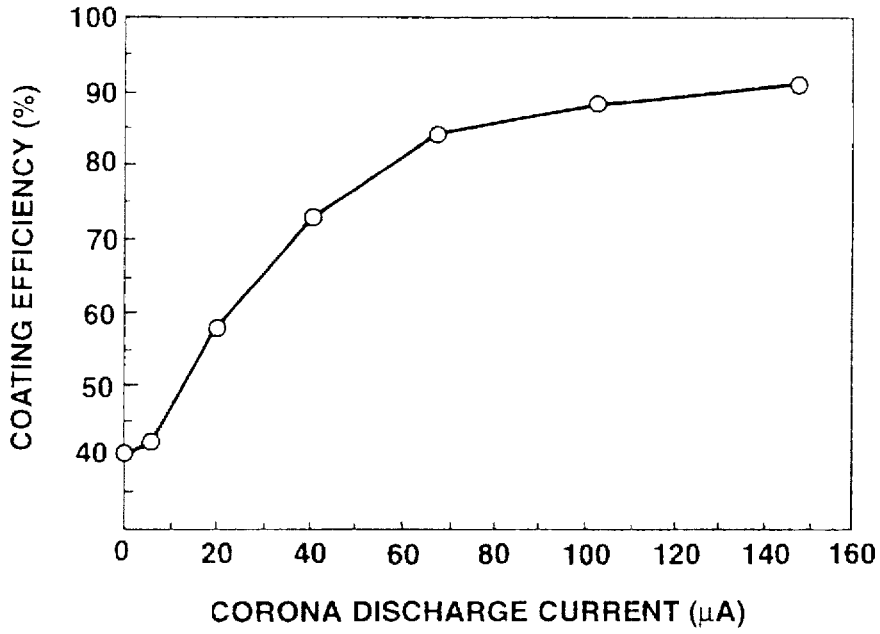
FIG. 3 is a graph showing the relationship between coating efficiency and corona discharge current in the electrostatic painting system of FIG. 2.

The above advantageous effects of this embodiment was experimentally confirmed as shown in the graph of FIG. 3 which indicates a change in the coating efficiency in terms of a change in the corona discharge current. This data of FIG. 3 depicts that the coating efficiency increases as the corona discharge current increases. In the experiment to obtain the data of FIG. 3, the coating efficiency was measured as follows: Paint was horizontally ejected from the spray gun (1) to an aluminum foil (not shown) which was located spaced apart by 300 mm from the front tip end of the spray gun. The aluminum foil had an area of 1 $m^2$. The coating efficiency is represented as a weight percentage (wt %) of the amount of the paint adhered to the aluminum foil relative to the amount of the paint ejected from the spray gun.

With the electrostatic painting system of the above embodiment, the voltage to be applied to the electrode of the spray gun can be lowered as compared with that in conventional electrostatic painting systems in case of obtaining the same corona discharge current and the same electric charge amount as those in the conventional electrostatic painting systems. This can largely reduce spark discharge and gentle the voltage gradient in the vicinity of the object to be painted, thereby reducing occurrence of a so-called frame phenomenon in which a thick paint layer is formed only at the end portions of the painted object and of Faraday cage phenomenon which deteriorates the adhesion characteristics of paint to a depression in the object to be painted.

It will be understood that the applied voltage to the electrode of the spray gun may be set within a range value between a value employed in this embodiment and a value employed in the conventional electrostatic painting system, thereby making it possible to improve the coating efficiency of paint within a range of preventing deterioration of the adhesion characteristics of the paint, taking account of balance between the coating efficiency and the adhesion characteristics of the paint.

Furthermore it will be appreciated that the spray gun 1 of this embodiment may be obtained under simple modification of a spray gun (not shown) used in the conventional electrostatic painting system, the modification including only replacing a pin-like electrode with the wire netting-shaped electrode 2, and optionally slightly enlarging a paint ejection opening (3) of the spray gun. Thus, spray guns which have been used hitherto can be put to practical use under the principle of the present invention avoiding waste.

Figure 4:
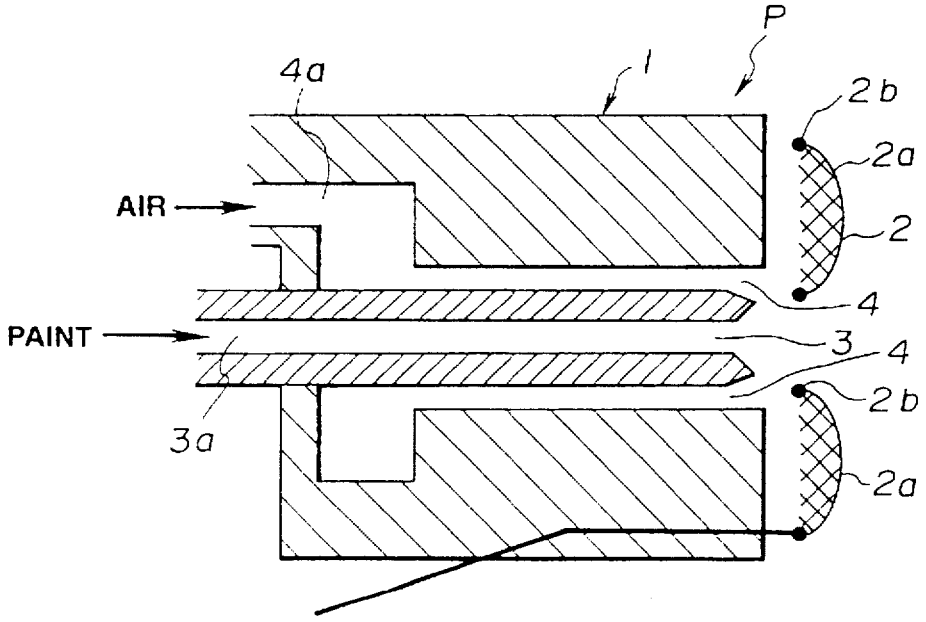
FIG. 4 is a fragmentary schematic sectional view of an essential part of a second embodiment of the electrostatic painting system according to the present invention.
Figure 5:
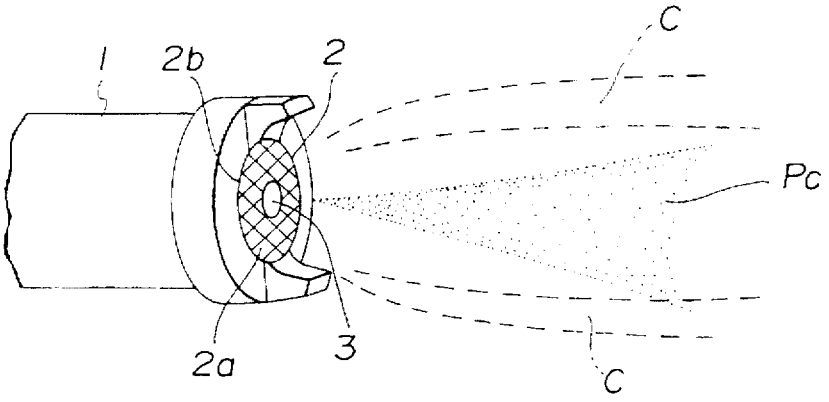
FIG. 5 is a fragmentary perspective view of the essential part of the electrostatic painting system of FIG. 4, showing the state of sprayed paint from the tip end of a spray gun forming part of the system.

FIGS. 4 and 5 illustrate an essential part of a second embodiment of the electrostatic painting system P according to the present invention, which is similar to that of the first embodiment of FIG. 4. In this embodiment, the paint ejection opening 3 is formed at the central portion of the front tip end face of the spray gun 1 and communicated with the paint supply passage 3*a*. The paint ejection opening 3 and the paint supply passage 3*a* are formed such that the axis of the spray gun 1 passes through them. The annular air opening 4 is coaxially formed around the paint ejection opening 3 and opened at the front tip end face of the spray gun 1. The air ejection opening 4 is communicated with the air supply passage 4*a* through which air flows under pressure. It will be understood that the paint ejection opening 3 and the air ejection opening 4 constitute an atomization mechanism for paint.

In this embodiment, the wire netting-like negative electrode 2 is formed annular and fixedly disposed immediately in front of the front tip end face of the spray gun 1. The annular electrode 2 is located around a space immediately in front of the paint ejection opening 3 and arranged coaxial with the paint ejection opening 3 and the paint supply passage 3*a*. The annular electrode 2 has a generally C-shaped cross-section.

The wire netting-like electrode 2 is connected to the negative terminal of the high voltage generating device and forms the electrostatic field and the corona discharge field between it and the object (not shown) to be painted, the object being grounded. The wire netting-like electrode 2 functions to provide electric charge to the atomized particles of the paint. In this embodiment, the wire netting-like electrode 2 includes an annular wire netting structure (no numeral) formed of fine tungsten wires 2*a* (for example, having a diameter of 0.02 mm). Additionally, thick tungsten wires 2*b* having a diameter larger than the fine tungsten wires 2*a* are woven at inner and outer peripheral portions of the annular wire netting structure thereby reinforcing the structure of the wire netting-like electrode 2, thus enabling the electrode 2 to securely maintain its annular shape. It will be understood that these thick tungsten wires 2*b* function not only to reinforce the structure of the electrode 2 but also to suppress a voltage drop in the fine tungsten wires 2*a*.

With the above electrostatic painting system P of this embodiment, when electric power is applied to the electrostatic painting system P, a negative high voltage is applied to the wire netting-like electrode 2 of the spray gun 1 thereby forming a corona discharge current between it and the grounded object to be painted. Paint is ejected from the paint ejection opening 3 to the space surrounded by the annular wire netting-like electrode 2 and atomized under the high pressure flow of air ejected from the air ejection opening 4. The atomized paint particles are then brought into contact with corona discharge current to be electrically charged. The charged paint particles are carried to the vicinity of the painted object by air flow and effectively adhere to the painted object under the action of their inertial force and coulomb force due to electric charges provided thereto. At this time, as shown in FIG. 5, the paint particles Pc spread in the shape of cone passing through the corona discharge current C thereby further improving the charging efficiency to the paint particles Pc.

In this embodiment, the outer peripheral portion of the wire netting-like electrode 2 of the spray gun 10 is located radially outward of the paint ejection opening 3 and the air ejection opening 4, and therefore it is possible to increase the outer diameter of the electrode 2 to facilitate increasing the surface area of the wire netting-like electrode 2. As a result, it is easily accomplished to increase the corona discharge current and the electric charging amount of the paint particles thereby improving the coating efficiency, and to lower the applied voltage while ensuring a necessary coating efficiency thereby improving safety and the adhesion characteristics of the paint to the object to be painted.

Figure 6:
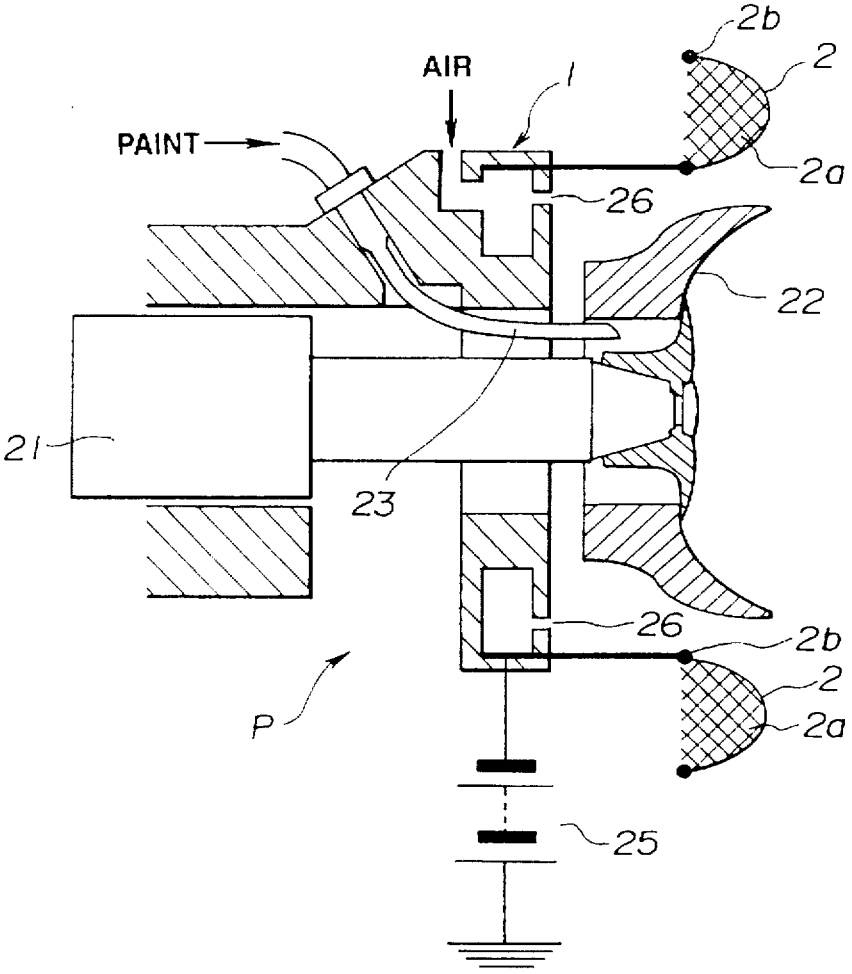
FIG. 6 is a fragmentary schematic sectional view of an essential part of a third embodiment of the electrostatic painting system according to the present invention.

FIG. 6 illustrates an essential part of a third embodiment of the electrostatic painting system P according to the present invention, which is similar to that of the second embodiment. In this embodiment, the spray gun 1 is of the so-called rotary atomization type and provided at its end section with a cup-shaped spraying head 22 which is drivably connected to an electric motor 21 supported in the spray gun 1. A paint ejection nozzle 23 is disposed in a manner that its tip end is inserted into the spraying head 22. The paint ejection nozzle 23 is connected to a paint supply passage 23*a* through which liquid paint flows to be supplied to the nozzle 23. The liquid paint supplied from the nozzle 23 into the spraying head 22 is scattered and spread radially under the action of centrifugal force due to rotation of the spraying head 22, so as to be effectively atomized.

The annular wire netting-like electrode 2 is disposed radially outward of the spraying head 22 in a manner to surround and to be slightly spaced from the spray head 22. The wire netting-like electrode 2 is connected to the negative terminal of a high voltage generating device 25 thereby forming electrostatic field and corona discharge field between it and the grounded object (not shown) to be painted. The wire netting-like electrode 2 of this embodiment includes the thick tungsten wires 2*b* which are woven respectively in the inner and outer peripheral portions of the annular wire netting structure formed of the fine tungsten wires 2*a*, as same as that in the second embodiment. Also in this embodiment, the annular wire netting-like electrode 2 has a generally C-shaped cross-section. Additionally, the wire netting-like electrode 2 is located slightly rearward relative to the tip end of the spraying head 22 of the atomization mechanism, and therefore atomized paint can be prevented from being attached to the electrode 2. The spray gun 1 of this embodiment is formed with an air ejection openings 26 through which air is ejected under pressure. Under the influence of this ejected air, the paint particles are scattered toward the side of the object to be painted, thereby further preventing the atomized paint particles from being attached to the wire netting-like electrode 2.

In this embodiment, it is preferable to apply a voltage having the same level as that to the electrode 2, to the spraying head 22, by which it is expected that the paint particles are subjected to contact electrification upon contacting with the spraying head 22 in addition to electric charging due to corona discharge.

With the above electrostatic painting system P of this embodiment, when a negative high voltage is applied to the wire netting-like electrode 2, stable corona discharge is produced between the electrode 2 and the grounded object to be painted.

Paint supplied through the paint nozzle 23 to the spraying head is atomized under the action of high speed rotation of the spraying head 22. The paint particles provided with negative charge from the spraying head 22 is further subjected to corona discharge to be further provided with electric charge.

The thus charged paint particles are carried to the vicinity of the painted object under the action of air flow ejected from the air ejection openings 26 and an air flow, as a corona wind, directing to the 25 directing to the object to be painted. Then, the paint particles effectively adhere to the painted object under the action of their inertial force and coulomb force due to electric charges provided thereto. At this time, the atomized paint particles can be prevented from adhering to the wire netting-like electrode 2 since the electrode 2 is located slightly rearward relative to the tip end of the spraying head 22 while the paint particles are blown by air stream from the air ejection opening 26.

Figure 7:
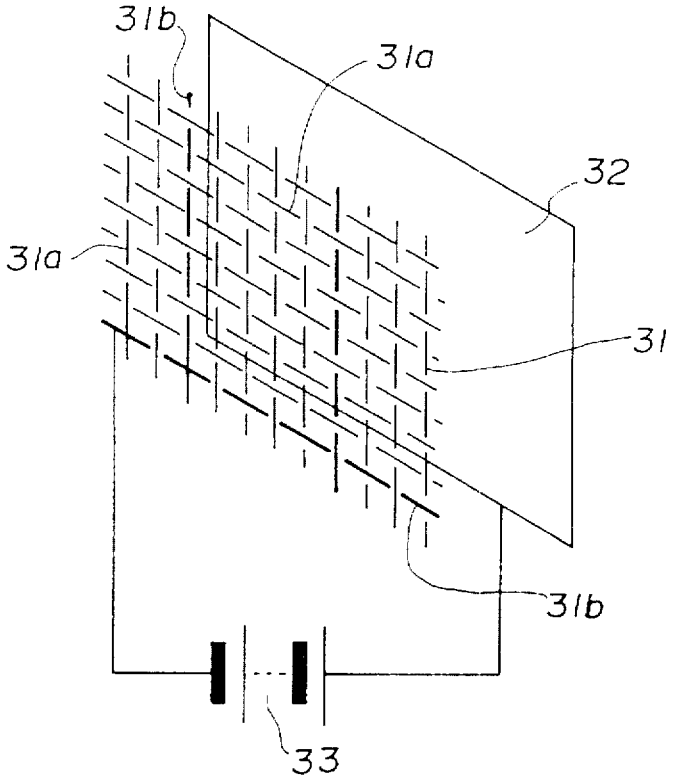
FIG. 7 is a perspective illustration showing the shape of an electrode in case that the principle of the present invention is applied to another system other than electrostatic painting systems.

While the principle of the method of producing corona discharge according to the present invention has been shown and described as being applied to the electrostatic painting systems in the above-discussed embodiments, it will be appreciated that the same principle may be applied to other systems or apparatuses, in which a wire netting-like electrode 31 corresponding to the above-mentioned electrode 2 is positioned facing to a flat plate type electrode 32 as shown in FIG. 7 in which the electrode 31 and the electrode 32 are respectively connected to the negative and positive terminals of a high voltage generating source 33.

Additionally, it is preferable that the wire netting-like electrode 31 includes thick wires 31*b* which are woven in the netting arrangement of fine wires 31*a* in order to maintain the structural strength and prevent voltage drop in the electrode 31, each thick wire 31*b* being thicker than each fine wire 31*a*.

Figure 8:
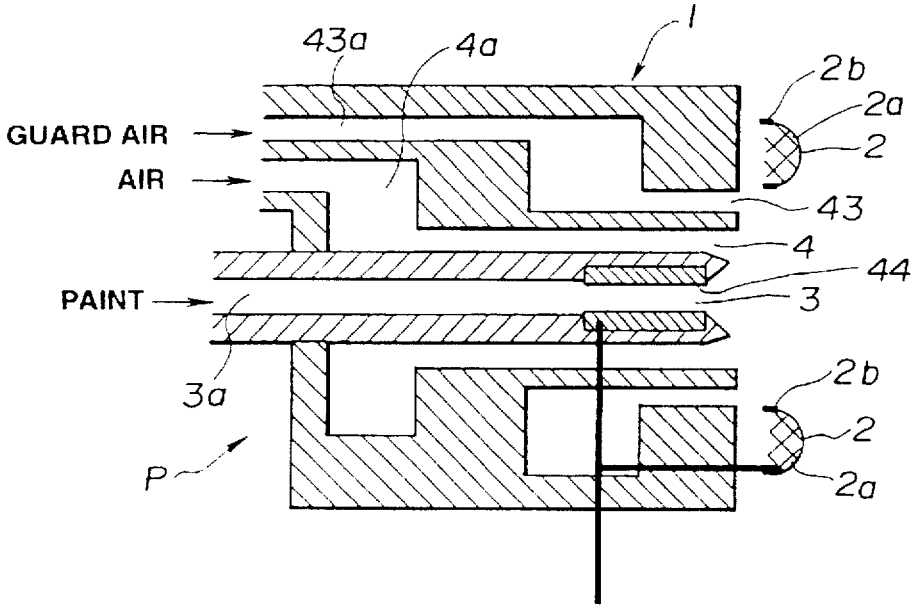
FIG. 8 is a fragmentary schematic sectional view of an essential part of a fourth embodiment of an electrostatic painting system according to the present invention.

FIG. 8 illustrates an essential part of a fourth embodiment of the electrostatic painting system P according to the present invention, similar to that of the second embodiment of FIG. 4. In this embodiment, the spray gun 1 is formed at its tip end face with the paint ejection opening 3 which is located such that the axis of the spray gun passes through the opening 3. The annular air ejection opening 4 is formed coaxially around the paint ejection opening 3 to form the atomization mechanism for the liquid paint to be supplied through the paint supply passage 3*a*. The spray gun 1 is provided with the annular wire netting-like electrode 2 as one electrode for producing corona discharge, and a cylindrical electrode 44 as another electrode for making contact electrification for particles of the paint ejected from the paint ejection opening 3.

The cylindrical electrode 44 for the purpose of contact electrification is disposed inside a pipe (no numeral) defining the paint supply passage 3*a*, in a manner to define therein the paint ejection opening 3. The cylindrical electrode 44 is connected to the negative terminal of the high voltage generating device (not shown) and forms an electrostatic field between it and the object to be painted, thereby applying negative high voltage to the object to be painted while providing negative charge to the paint in the state of a liquid column before being atomized. The cylindrical electrode 44 is made, for example, of stainless steel or brass.

The wire netting-like electrode 2 for the purpose of producing corona discharge is located radially outward of the air ejection opening 4 and fixedly disposed immediately in front of the tip end face of the spray gun 1. The electrode 2 is located nearer to the object to be painted, than the other electrode 44 and connected to the negative terminal of the high voltage generating device so as to be supplied with negative high voltage as same as the cylindrical electrode 44. The wire netting-like electrode 2 is formed generally annular so as to uniformly produce corona discharge throughout the whole outer peripheral surface thereof. Accordingly, electric charge is effectively provided to the atomized paint particles. The wire netting-like electrode 2 includes an annular wire netting structure (no numeral) having a mesh size of 50 mesh, formed of tungsten wires 2*b* having a diameter of 0.02 mm. Thick tungsten wires 2*b*, 2*b* are woven respectively at the inner and outer peripheral portions of the wire netting structure in order to reinforce the wire netting structure.

Another air ejection opening 43 is formed radially between the air ejection opening 3 and the wire netting-like electrode 2 and communicated with an air supply passage 43*a* through which air flows under pressure. This air ejection opening 43 functions to eject guard air stream for the purpose of protecting the wire netting-like electrode 2 from being polluted with the atomized paint particles from the atomization mechanism.

With the above electrostatic painting system P of the fourth embodiment, when electric power is applied to the system P, negative high voltage is applied to the cylindrical electrode 44 of the spray gun 1. The liquid paint supplied through the paint supply passage 3*a* comes into contact with the cylindrical electrode 44 to be negatively charged, and then ejected from the paint ejection opening 3 toward the object to be painted, so that the ejected paint is effectively atomized under electrostatic atomization effect and under the influence of high speed air flow ejected from the air ejection opening 4 for the atomization purpose while the atomized paint particles are accelerated in speed of flight to the object to be painted. At this time, negative high voltage which has the same voltage level as that applied to the electrode 44 is applied to the wire netting-like electrode 2 thereby producing stable corona discharge throughout the whole outer peripheral surface of the electrode 2.

Air stream ejected from the air ejection opening 43 prevents the paint particles from adhering to the wire netting-like electrode 2 and additionally prevents the fine paint particles flying toward the object to be painted, from spreading thus serving also as a kind of curtain.

Accordingly, the most paint particles are electrically charged under the contact electrification, and the outer peripheral portion of the flow or mass of the atomized paint particles is covered with charged air flow, thereby increasing the electric charge amount of the paint particles moving toward the object to be painted, without increasing the applied voltage to the electrodes 2, 44. As a result, the coating efficiency of the paint is largely improved without increasing spark discharge. Additionally, with the above manner of the electrostatic painting, there is a tendency that convergence of flow or mass of the paint particles are improved as compared with conventional electrostatic painting manners, and therefore it is possible to increase the amount of the paint to be coated, at a location intended by an operator thereby saving paint.

The reason why the same level voltage is applied to the both electrodes 2, 44 is to use common peripheral circuits for the electrodes 2, 44 thereby reducing a production cost of the electrostatic painting system. In this regard, it will be appreciated that preferential discharge can be made from the wire netting-like electrode 2 by locating the electrode 2 nearer to the painted object than the cylindrical electrode 44 though the two electrodes 2, 44 are the same in voltage level. Accordingly, in case of setting different voltage levels respectively for the two electrodes 2, 44, it is preferable to set a higher voltage level for the wire netting-like electrode 2 than for the cylindrical electrode 44 so that corona discharge is produced mainly at the wire netting-like electrode 2.

Figure 9:
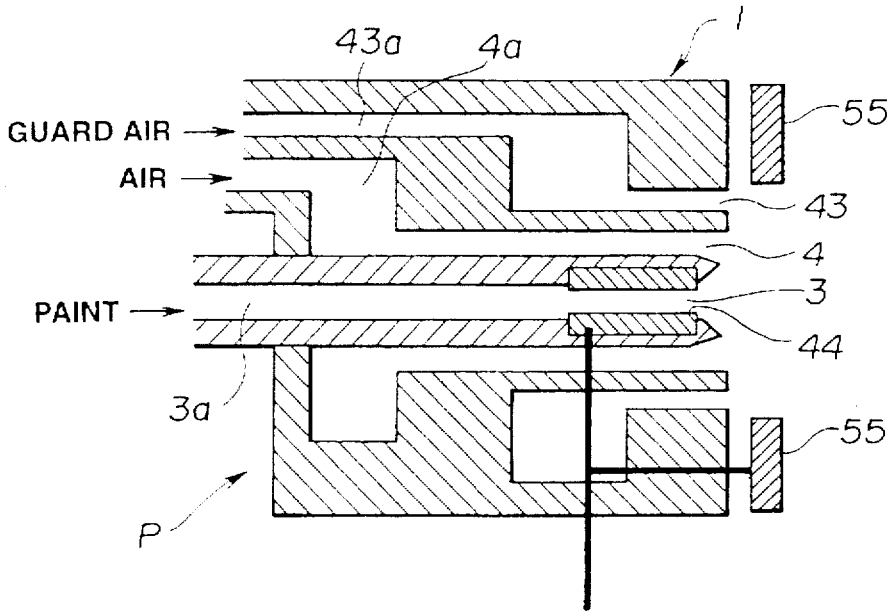
FIG. 9 is a fragmentary schematic sectional view of an essential part of a fifth embodiment of the electrostatic painting system according to the present invention.

FIG. 9 illustrates an essential part of a fifth embodiment of the electrostatic painting system P according to the present invention, which is similar to the fourth embodiment of FIG. 8 with the exception that the annular wire netting-like electrode formed of tungsten wires of the embodiment of FIG. 8 is replaced with an electrode 55 formed of an electrically conductive plastic which is relatively low in material cost and high in moldability. Examples of the electrically conductive plastic are polytetrafluoroethylene containing dispersed carbon or silver particles, and epoxy resin or polyvinyl chloride containing dispersed carbon or silver particles.

Accordingly, with this embodiment, the spray gun 1 of the electrostatic painting system can be facilitated in production and low in material cost, thereby making possible to reduce the production cost of the electrostatic painting system.

More specifically, as shown in FIG. 9, the spray gun 1 is formed at the central portion of the tip end side with the paint ejection opening 3 through which liquid paint is ejected. The air ejection opening 4 is formed around the paint ejection opening 3 in order to atomize the paint ejected from the paint ejection opening 3. The electrode 55 formed of the conductive plastic is fixedly disposed radially outward of the air ejection opening 4. The electrode 55 is formed annular and located immediately in front of the tip end of the spray gun 1. As shown, the plastic electrode 55 of this embodiment has a rectangular cross-section. The air ejection opening 43 for the guard air ejection purpose is located radially between the plastic electrode 55 and the air ejection opening 4.

It will be appreciated that it is possible to produce corona discharge uniformly throughout the whole peripheral portion of the flow or mass of the atomized paint particles. The shape of the plastic electrode is not limited to the annular shape, in which the plastic electrode is formed cylindrical and has a tip end formed like a knife edge thereby producing corona discharge uniformly throughout the whole peripheral portion of the flow of the atomized paint particles in case that the spray gun is used upon being vertically supported relative to the object to be painted. It will be understood that the plastic electrode 55 may be formed into the wire netting-like shape.

Figure 10:
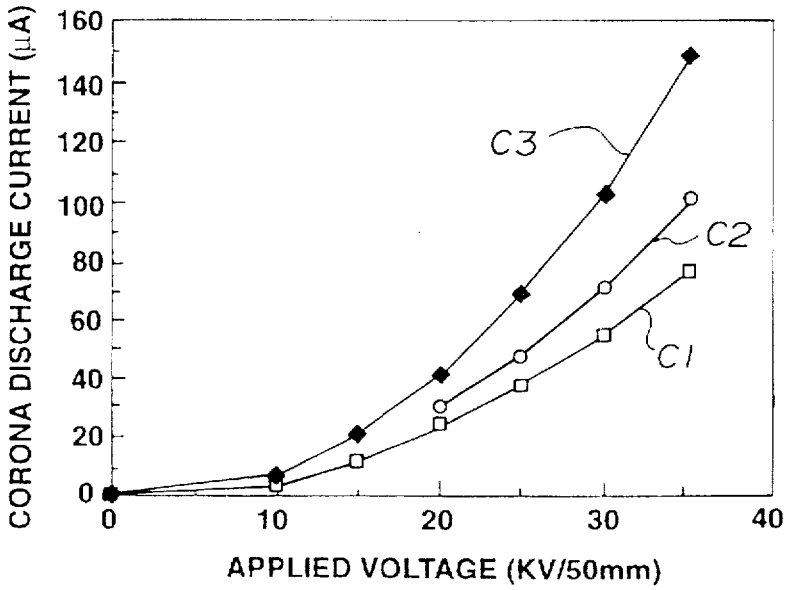
FIG. 10 is a graph showing the effect of shape and material of an electrode on corona discharge current in corona discharge.

Effectiveness of the plastic electrode was experimentally confirmed as shown in the graph of FIG. 10 which represents a change in the corona discharge current in terms of a change in voltage applied to the electrode for the corona discharge. In the graph of FIG. 10, a curve Cl indicates a case using a conventional pin-shaped electrode (not shown) for production of corona discharge; a curve C2 indicates a case using the plastic electrode 55 as shown in FIG. 9; and a curve C3 indicates a case using the wire netting-like electrode as shown in FIG. 8. The graph of FIG. 10 apparently demonstrates that the inexpensive plastic electrode 55 is lower in corona discharge current than the wire netting-like electrode but higher in corona discharge current than the conventional pin-shaped electrode.

Figure 11:
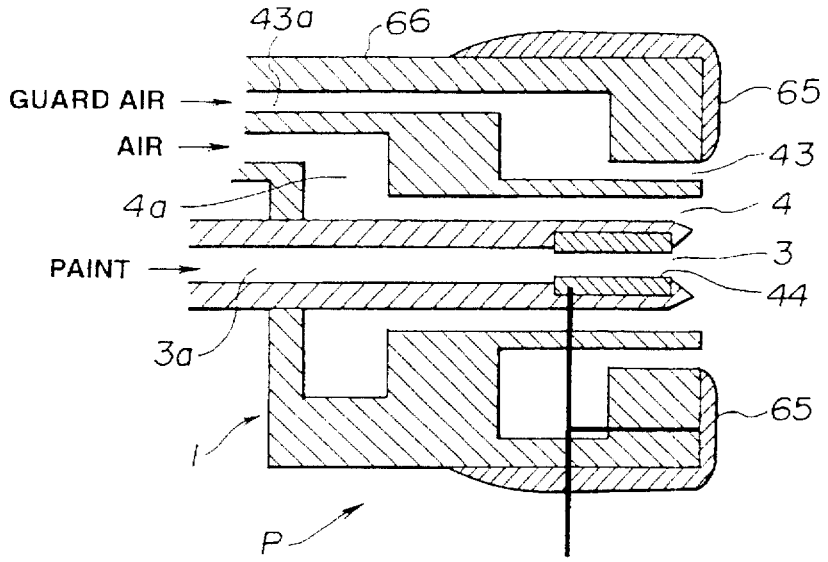
FIG. 11 is a fragmentary schematic sectional view of an essential part of a sixth embodiment of the electrostatic painting system according to the present invention.

FIG. 11 illustrates an essential part of a sixth embodiment of the electrostatic painting system P according to the present invention, which is similar to the fifth embodiment of FIG. 9 with the exception that the plastic electrode 55 in FIG. 9 is replaced with a coating layer 65 formed of an electrically conductive material. Examples of the electrically conductive material are adhesives of electrically conductive plastics such as polytetrafluoroethylene containing dispersed carbon or silver particles, and epoxy resin or polyvinyl chloride containing dispersed carbon or silver particles. This embodiment makes possible to further facilitate the spray gun and lower the material cost of the spray gun, thereby reducing production cost of the electrostatic painting system employing corona discharge.

More specifically, as shown in FIG. 11, the spray gun 1 is formed at the central portion of the tip end side with the paint ejection opening 3 through which liquid paint is ejected. The air ejection opening 4 is formed around the paint ejection opening 3 in order to atomize the paint ejected from the paint ejection opening 3. The electrode 65 of the conductive plastic coating layer is fixedly formed on an outer peripheral section 66 (formed of an electrically insulating material) of the spray gun 1. More specifically, the coating layer electrode 65 is formed on the tip end face and on the peripheral surface of the outer peripheral section 66 at the tip end portion as shown in FIG. 11. Accordingly, the coating layer electrode 65 is formed annular and located radially outward of the air ejection opening 4. The air ejection opening 43 for the guard air ejection purpose is located radially between the plastic electrode 55 and the air ejection opening 4.

While the coating layer electrode 65 has been shown and described as being formed of the electrically conductive plastic in the sixth embodiment, it will be understood that the electrode 65 may be formed of other electrically conductive materials which can be coated and capable of producing corona discharge uniformly throughout the whole peripheral portion of the flow or mass of the paint particles. An example of such material is an electrically conductive paint which is relatively inexpensive in cost and excellent in moldability, in which the electrically conductive paint may be painted at the position similar to that of the coating layer electrode 65 in FIG. 11. The electrically conductive paint contains dispersed carbon or silver particles, and is available as Dotite Series (trade name) produced by Fujikurakasei Co., Ltd. in Japan.

Figure 12:
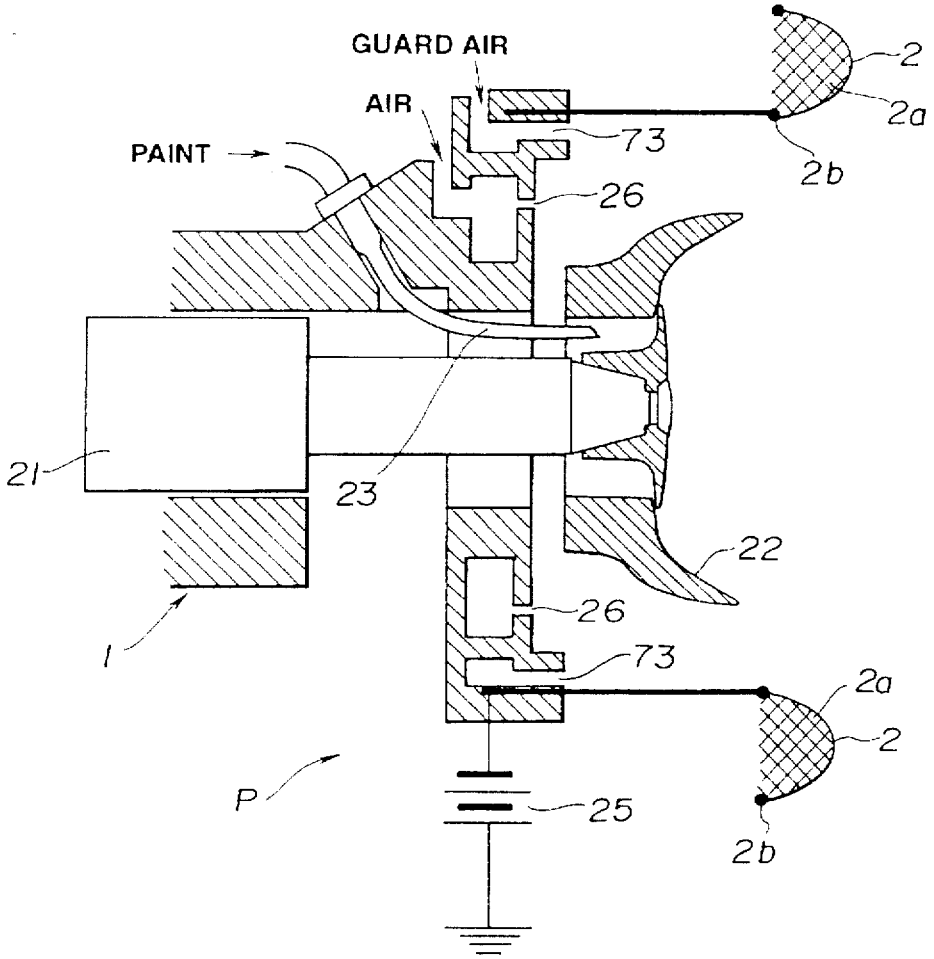
FIG. 12 is a fragmentary schematic sectional view of an essential part of a seventh embodiment of the electrostatic painting system according to the present invention.

FIG. 12 illustrates an essential part of a seventh embodiment of the electrostatic painting system P according to the present invention, which is similar to that of the third embodiment of FIG. 6 with the exception that an additional annular air ejection opening 73 is formed to eject guard air in order to prevent paint particles from contacting with the wire netting-like electrode 2.

In this embodiment, the spray gun 1 is provided at its tip end section with the electric motor 21 which is adapted to drive the spraying head 22, constituting the atomization mechanism. The paint nozzle 23 is disposed to supply liquid paint into the rotating spraying head 22 and to scatter it radially outwardly under the centrifugal force generated owing to the rotating spraying head 22 so as to effectively atomized it.

The spraying head 22 in this embodiment is connected to the negative terminal of the high voltage generating device 25 and forms an electrostatic field between it and the grounded object (not shown) to be painted. Thus, the spraying head 22 applies negative high voltage to the object to be painted and provides negative charge to the liquid column-like paint in a state before atomization. In other words, the spraying head 22 serves also as an electrode.

Additionally, the wire netting-like electrode 2 is located radially outward of the spray head 22 as the electrode, and includes the annular wire netting structure formed of the fine wires 2*a*. The thick wires 2*b* are woven at the inner and outer peripheral portions of the wire netting structure in order to reinforce the wire netting structure and to prevent a voltage drop from occurring in the electrode 2. The electrode 2 is connected to the negative terminal of the high voltage generating device 25 and forms the electrostatic field and the corona discharge field between it and the grounded object (not shown) to be painted.

The spray gun 1 is formed with the air ejection opening 26 disposed radially between the spraying head 22 and the wire netting-like electrode 2 in order to eject high speed air flow so as to atomize the paint and to accelerate the flight speed of the atomized paint particles toward the object to be painted.

Additionally, the guard air ejection opening 73 is formed radially outward of the air ejection opening 26 in order to prevent the wire netting-like electrode 2 from being contaminated with atomized paint particles.

With the thus arranged electrostatic painting system P of the seventh embodiment, when electric power is applied to the electrostatic painting system P, negative high voltage is applied to the wire netting-like electrode 2 so that stable corona discharge is produced between it and the object to be painted. The liquid paint supplied into the rotating spraying head 22 is atomized under the effect of high speed rotation of the spraying head 22, during which negative charge is provided from the spraying head 22 to the atomized paint particles. The negatively charged paint particles are further charged with the negative charge produced owing to the above corona discharge.

The thus charged paint particles are carried to the vicinity of the painted object under the action of air flow ejected from the air ejection openings 26 and an air flow, as a corona wind, directing to the object to be painted. Then, the paint particles effectively adhere to the painted object under the action of their inertial force and coulomb force due to electric charges provided thereto. At this time, the atomized paint particles can be prevented from adhering to the wire netting-like electrode 2 since the electrode 2 is located slightly rearward relative to the tip end of the spraying head 22 while the paint particles are blown by air stream from the guard air ejection opening 73.

It will be understood that the wire netting-like electrode 2 may be located slightly rearward of the tip end of the spraying head 22, in which the paint particles can be blown by air stream ejected from the air ejection opening 26 thereby further lowering the possibility of the paint particles adhering to the wire netting-like electrode 2.

While the electrostatic painting systems have been shown and described in the above-discussed embodiments, it will be appreciated that the principle of the present invention may be applied to a variety of other systems and apparatuses employing corona discharge.

Although an electric source device, a safety device and the like for the electrostatic painting systems have been omitted in the above-discussed embodiments, it is a matter of course that such devices having known arrangements will be used in combination of the spray guns shown and described as a part of each electrostatic painting system.

While the wire netting-like electrodes 2 of the special shapes have been shown and described to be used in the above-discussed embodiments, it will be appreciated that the wire netting-like electrodes 2 may be formed to have other shapes.

What is claimed is:

1. An electrostatic painting system comprising:

a spray gun including:

means for atomizing a liquid paint to obtain atomized particles of the paint, and electrode means for forming an electrostatic field and a corona discharge field between said electrode and an object to be painted and for providing electric charge to the atomized particles of the paint, said electrode being formed of one of a wire netting-like material and an electrically conductive plastic.

2. An electrostatic painting system as claimed in claim 1, wherein said wire netting-like electrode is formed annular and disposed radially outward of said atomizing means.

3. An electrostatic painting system as claimed in claim 2, wherein said wire netting-like electrode includes a wire-netting structure formed of first wires, and a second wire woven in the wire netting structure and having a diameter larger than that of said first wire.

4. An electrostatic painting system as claimed in claim 2, wherein said atomizing means includes a spraying head which is rotatable to generate a centrifugal force by which the liquid paint is atomized, wherein said spray gun further comprises means defining an air ejection opening through which the atomized particles of the paint is scattered toward the object to be painted.

5. An electrostatic painting system as claimed in claim 4, wherein said wire netting-like electrode is disposed rearward of a tip end of said spraying head relative to the object to be painted.

6. An electrostatic painting system as claimed in claim 1, wherein said wire netting-like material includes a first wire which forms part of a wire netting structure, and a second wire which is woven with the first wire in said wire netting structure, the first wire being smaller in diameter than the second wire.

7. An electrostatic printing method comprising the steps of:

providing at least first and second electrodes to which a high voltage is applied;

causing a liquid paint to contact said first electrode before atomization of the liquid paint;

atomizing the liquid paint to form atomized paint particles;

ejecting a first air flow to form a first air stream surrounding the atomized paint particles; and causing the first air stream to contact said second electrode; and wherein the high voltage which is applied to said first and second electrodes, has the same polarity.

8. An electrostatic painting method as claimed in claim 7, further comprising the step of ejecting second air to form a second air stream under the influence of which the atomized paint particles is directed to an object to be painted, said second air ejecting step including ejecting the second air through a second air ejection opening, wherein said first air ejecting step including ejecting the first air through a first air ejection opening which is separate from the second air ejection opening.

9. An electrostatic painting method as claimed in claim 7, further comprising the step of forming the second electrode generally annular.

10. An electrostatic painting method as claimed in claim 7, further comprising the step of locating the second electrode nearer to the object than the first electrode.

11. An electrostatic painting method as claimed in claim 7, further comprising the step of forming the second electrode into a wire netting-like shape.

12. An electrostatic painting method as claimed in claim 7, further comprising the step of forming the second electrode of an electrically conductive plastic.

13. An electrostatic painting method comprising the steps of:

providing at least first and second electrodes to which high voltage is applied;

causing a liquid paint to contact said first electrode before atomization of the liquid paint;

atomizing the liquid paint to form atomized paint particles;

ejecting a first air flow to form a first air stream surrounding the atomized paint particles; and causing the first air stream to contact said second electrode;

wherein the electrode providing step includes forming the second electrode by coating a material consisting of one of an electrically conductive plastic and an electrically conductive paint, on the surface of a tip end section of a spray gun forming part of an electrostatic painting system.

14. An electrostatic painting system comprising:

a spray gun including:

means for atomizing a liquid paint to obtain atomized particles of paint;

a first electrode which is contactable with the liquid paint before atomization of the liquid paint;

first air ejecting means for ejecting a first flow of air to form a first air stream surrounding the atomized paint particles; and a second electrode which is contactable with the first air stream to form an electrostatic field and a corona discharge field between said second electrodes and an object to be painted and for providing electric charge to the atomized paint particles; and wherein said first and second electrodes are connected with a source of high voltage so as to have the same polarity.

15. An electrostatic painting system comprising:

a spray gun including:

means for atomizing a liquid paint to obtain atomized particles of paint;

a first electrode which is contactable with the liquid paint before atomization of the liquid paint;

first air ejecting means for ejecting a first flow of air to form a first air stream surrounding the atomized paint particles;

a second electrode which is contactable with the first air stream to form an electrostatic field and a corona discharge field between said second electrode and an object to be painted and for providing electric charge to the atomized paint particles; and second air ejecting means for ejecting a second air flow to form a second air stream under the influence of which the atomized paint particles are directed to the object to be painted, and second air ejecting means including a second air injection opening through which the second air flow is ejected, wherein said first air ejecting means includes means for ejecting the first flow of air through a first air ejection opening which is separate from the second air ejection opening.

16. An electrostatic painting system as claimed in claim 15, wherein a second electrode is formed generally annular.

17. An electrostatic painting system as claimed in claim 15, further comprising means for locating the second electrode nearer to the object than the first electrode.

18. An electrostatic painting system as claimed in claim 15, wherein the second electrode is formed into a wire netting-like shape.

19. An electrostatic painting system as claimed in claim 15, wherein the second electrode is formed of an electrically conductive plastic.

20. An electrostatic painting system as claimed in claim 15, wherein said first and second electrodes are connected with each other and a predetermined terminal of a source of high voltage.

21. An electrostatic painting system comprising:

a spray gun including means for atomizing a liquid paint to obtain atomized particles of the paint, and a first electrode which is contactable with the liquid paint before atomization of the liquid paint;

means for ejecting first air to form first air stream surrounding the atomized paint particles; and a second electrode which is contactable with the first air stream to form an electrostatic field and a corona discharge field between said second electrode and an object to be painted and for providing electric charge to the atomized paint particles;

wherein said second electrode is a coating of a material selected from the group consisting of an electrically conductive plastic and an electrically conductive paint, formed on the surface of a tip end section of said spray gun.

* * * * *